US010415161B2

(12) United States Patent
Hozumi

(10) Patent No.: US 10,415,161 B2
(45) Date of Patent: Sep. 17, 2019

(54) METHOD FOR WEAVING MULTIPLY GAUZE, AND MULTIPLY GAUZE WOVEN FABRIC

(71) Applicant: UCHINO CO., LTD., Chuo-ku, Tokyo (JP)

(72) Inventor: Shuichi Hozumi, Tokyo (JP)

(73) Assignee: UCHINO CO., LTD., Tokyo (JP)

( * ) Notice: Subject to any disclaimer, the term of this patent is extended or adjusted under 35 U.S.C. 154(b) by 0 days.

(21) Appl. No.: 15/533,951

(22) PCT Filed: Dec. 10, 2014

(86) PCT No.: PCT/JP2014/082685
§ 371 (c)(1),
(2) Date: Jun. 7, 2017

(87) PCT Pub. No.: WO2016/092652
PCT Pub. Date: Jun. 16, 2016

(65) Prior Publication Data

US 2017/0321354 A1 Nov. 9, 2017

(51) Int. Cl.

| | |
|---|---|
| ***D03D 11/02*** | (2006.01) |
| ***D03D 49/10*** | (2006.01) |
| ***D03D 19/00*** | (2006.01) |
| *D03D 13/00* | (2006.01) |

(52) U.S. Cl.
CPC ..... *D03D 11/02* (2013.01); *D03D 19/00* (2013.01); *D03D 49/10* (2013.01)

(58) Field of Classification Search
CPC ..... D03D 19/00; D03D 11/00; D03D 15/00; D03D 2700/0111; D03D 9/00
See application file for complete search history.

(56) References Cited

U.S. PATENT DOCUMENTS 2,424,928 A 7/1947 Glendinning et al.
3,677,305 A * 7/1972 Cutting ..... D03D 49/20 139/99

(Continued)

FOREIGN PATENT DOCUMENTS

CN 1912217 A 2/2007
CN 103261499 A 8/2013

(Continued)

OTHER PUBLICATIONS https://textilecourse.blogspot.com/2018/04/necessity-yarn-tension-weaving.html.*

(Continued)

*Primary Examiner* — Robert H Muromoto, Jr.
(74) *Attorney, Agent, or Firm* — Masuvalley & Partners

(57) ABSTRACT

To provide a gauze woven fabric which has excellent opaqueness, moisture retention properties, water absorbency and comfort for skin while maintaining light weight and air permeability which are characteristic properties of gauze woven fabrics. Warps are supplied from a first beam, and wefts are then drawn across the warps to form a tight layer A. Warps are supplied from a second beam that has a higher supply speed than that of the first beam, and wefts are then drawn across the warps to form a loosened layer B. Subsequently, knotting points for connecting the layer A to the layer B regularly are formed.

5 Claims, 2 Drawing Sheets

(56) References Cited

U.S. PATENT DOCUMENTS

| | | | | | |
|---|---|---|---|---|---|
| 3,753,451 | A * | 8/1973 | Hosono | D03D 49/06 | 139/110 |
| 3,756,288 | A * | 9/1973 | Seo | D03D 11/00 | 139/383 R |
| 3,872,895 | A * | 3/1975 | Takada | D03D 1/0005 | 139/383 R |
| 3,910,319 | A * | 10/1975 | Bassing | D03D 49/20 | 139/308 |
| 4,411,293 | A * | 10/1983 | Santucci | D03D 49/12 | 139/110 |
| 6,029,715 | A * | 2/2000 | Matsumoto | D03D 49/04 | 139/102 |
| 6,163,733 | A * | 12/2000 | Rubel | B65H 61/005 | 700/130 |
| 6,247,504 | B1 * | 6/2001 | Vermeulen | B65H 59/22 | 139/368 |
| 7,287,553 | B2 * | 10/2007 | Wahhoud | D03C 7/06 | 139/101 |
| 7,303,163 | B2 * | 12/2007 | Huss | D04B 15/48 | 242/418.1 |
| 7,320,343 | B2 * | 1/2008 | Speich | D03C 3/10 | 139/110 |
| 7,520,303 | B2 * | 4/2009 | Mertens | D03D 27/10 | 139/102 |
| 7,632,763 | B2 * | 12/2009 | Newton | B29C 70/22 | 442/164 |
| 7,699,949 | B2 * | 4/2010 | Newton | B29C 70/22 | 139/384 R |
| 8,187,401 | B2 * | 5/2012 | Newton | B29C 70/22 | 156/148 |
| 2005/0067042 | A1 * | 3/2005 | Hirota | D03D 27/06 | 139/426 R |
| 2006/0169345 | A1 * | 8/2006 | Speich | D03C 3/10 | 139/55.1 |
| 2006/0169347 | A1 * | 8/2006 | Wahhoud | D03C 7/06 | 139/383 R |
| 2006/0184267 | A1 * | 8/2006 | Huss | D04B 15/48 | 700/130 |
| 2007/0006932 | A1 * | 1/2007 | Mertens | D03D 27/10 | 139/37 |
| 2007/0034277 | A1 | 2/2007 | Takai | | |
| 2009/0194188 | A1 * | 8/2009 | Ruschulte | B60R 21/235 | 139/421 |
| 2010/0108244 | A1 * | 5/2010 | Newton | B29C 70/22 | 156/229 |
| 2013/0270389 | A1 | 10/2013 | Godon et al. | | |
| 2015/0299914 | A1 * | 10/2015 | Gotti | B65H 59/00 | 66/132 R |
| 2016/0201233 | A1 * | 7/2016 | Hozumi | D03D 19/00 | 442/246 |
| 2016/0208420 | A1 * | 7/2016 | Hozumi | D03D 15/0027 | |
| 2016/0281276 | A1 * | 9/2016 | Hozumi | D03D 11/02 | |
| 2016/0289870 | A1 * | 10/2016 | Hozumi | D03D 11/00 | |

FOREIGN PATENT DOCUMENTS

| | | | |
|---|---|---|---|
| EP | 1752569 | A2 | 2/2007 |
| FR | 2984925 | A1 | 6/2013 |
| JP | 55-008674 | U | 1/1980 |
| JP | 10-195735 | A | 7/1998 |
| JP | 10-219544 | A | 8/1998 |
| JP | 2000-220058 | A | 8/2000 |
| JP | 2003-239158 | A | 8/2003 |
| JP | 2003-301347 | A | 10/2003 |
| JP | 2007-070788 | A | 3/2007 |
| JP | 3891856 | B | 3/2007 |
| JP | 3144112 | U | 8/2008 |
| JP | 2011-144477 | A | 7/2011 |
| JP | 2012-001847 | A | 1/2012 |
| JP | 5534383 | B | 6/2014 |
| JP | 5610866 | B | 10/2014 |

OTHER PUBLICATIONS

SIPO, Office Action dated Dec. 4, 2017 in corresponding Chinese Application No. 201480083961.1.

JPO, Decision on Opposition dated Sep. 28, 2017 in corresponding Japanese Patent No. 5999744 (Application No. 2016-501686).

International Search Authority/JPO, International Search Report dated May 19, 2015 in International Patent Application No. PCT/JP2014/082685 (with English translation), 4 pages.

IPEA/JP, International Preliminary Report on Patentability dated Sep. 1, 2015 in International Patent Application No. PCT/JP2014/082685 (with English translation), 14 pages.

JPO, Notification of Reasons for Refusal dated Jun. 8, 2016 in corresponding JP Application No. 2016-501686 (with English translation), 4 pages.

JPO, Decision to Grant a Patent dated Aug. 24, 2016 in corresponding JP Application No. 2016-501686 (with English translation), 6 pages.

TIPO, Office Action dated Mar. 3, 2017 in corresponding TW Application No. 104139578, 5 pages.

Opposition filed on Mar. 15, 2017 in corresponding JP Application No. (Patent No. 5999744).

Notice of Reason for Cancellation filed on Mar. 15, 2017 in corresponding JP Application No. (Patent No. 5999744).

Explanation of Evidence filed on Mar. 15, 2017 in corresponding JP Application No. (Patent No. 5999744), 4 pages.

[Documentary evidence Ko-2] Kouji Tamai, "Research for Development of multi-layer structure textiles using high-functionally fiber and application to material for liquid filter", Study report of Ehime institute of industry technology, 2010, No. 48, p. 55-59.

[Documentary evidence Ko-3] Shoji Ishimaru et al., "Studies on Design Techniques of Towel Products(Part2)—Development of Towel muffler products superior in decorativeness—", Study report of Ehime institute of industry technology, 2012, No. 50, p. 48-51.

[Documentary evidence Ko-4-1] Editing, Japan Spinners' Association, Textile engineering [2] : From a textile, knit to dyeing and finish, Dec. 1991, published by Association of textile industry structure improvement business, p. 75 http://www.smrj.go.jp/keiei/dbps_data/_material_/common/chushou/b_keiei/keieiseni/pdf/45300-13.pdf.

[Documentary evidence Ko-4-2] http://www.smrj.go.jp/keiei/chosa/seni/archives/045300.html (The evidence indicating documents of Ko-4-1 "Studies on Design Techniques of Towel Products(Part2)—Development of Towel muffler products superior in decorativeness—" have been published in Dec. 1991.

[Documentary evidence Ko-6-1] Tatsuo Adachi et al., "Textile Engineering II, Textile", Textile Industry Education Meeting for the Study in Japan, Jikkyo Shuppan Co., Ltd., published before Dec. 9, 2011, p. 283-286.

[Documentary evidence Ko-6-2] https://www.j-platpat.inpit.go.jp/web/tokujitsu/pfwg/BTmPFWJ_GM402GetContentsAction.action, Attached documents of a Written Supplement submitted about JPPatent Application No. 2010-006250 on Dec. 9, 201 (The evidence indicating documents Ko-6-1 "Textile Engineering II, Textile" having been well known by Dec. 9, 2011 at the latest).

EPO, The European Extended Search Report dated Jul. 24, 2018 in corresponding European Patent Application No. 14908010.3, 8 pages.

* cited by examiner prior art

METHOD FOR WEAVING MULTIPLY GAUZE, AND MULTIPLY GAUZE WOVEN FABRIC

RELATED APPLICATIONS

This application is the U.S. National Phase application under 35 U.S.C. § 371 of International Patent Application No. PCT/JP2014/082685, filed on Dec. 10, 2014, which is hereby expressly incorporated by reference in its entirety for all purposes.

TECHNICAL FIELD

The present invention relates to a method for weaving multiply gauze and a multiply gauze woven fabric woven by the method.

BACKGROUND ART

A gauze woven fabric is a plain-woven fabric roughly woven by using a relatively thin thread. The gauze woven fabric is characterized by lightweight and breathability.

When the gauze woven fabric is applied to cloth for clothes and bedding by utilizing the characteristics thereof, there is still room for improvement in transparency preventing property, heat-retaining property, water absorbency, and softness.

Transparency preventing property will be improved if two or more sheets of gauze are combined to form a multiply woven fabric. On the other hand, heat-retaining property and water absorbency will be improved because of the layered structure. A remarkable improvement, however, cannot be expected. Even with the structure, softness will not be improved at all.

By the way, a towel woven gauze (a gauze woven towel or a pile gauze) can be exemplified as a gauze woven fabric that is excellent in transparency preventing property, heat-retaining property, water absorbency, and softness (Patent Literature 1).

CITATION LIST

Patent Literature

Patent Literature 1
JP 2000-220058A

SUMMARY OF INVENTION

A towel woven gauze has both a strong point of gauze and a strong point of towel, which, however, is heavyish when applied to cloth for clothes and bedding because it requires piles. In other words, lightweight and breathability which are characteristics of gauze woven fabric cannot be sufficiently utilized.

In order to solve the above problem, the present invention provides a gauze woven fabric excellent in transparency preventing property, heat-retaining property, water absorbency, and comfort for skin (softness) while retaining lightweight and breathability.

Technical Problem

Solution to Problem

The invention capable of solving the above problem is a method for weaving a multiply gauze including feeding warps from a first beam to form a tight layer A, and concurrently feeding warps from a second beam having a feeding speed higher than that of the first beam to form a loosened layer B in comparison with the tensile strength of the warps of the layer A, and forming connection parts connecting the layer A to the layer B.

In the above described invention, preferably, the feeding speed of the second beam is 0.5 to 5.0% higher than the feeding speed of the first beam.

In the above described invention, preferably, the multiply gauze is composed of a plurality of layers including a surface layer, an intermediate layer, and a back layer, wherein the layer A is formed as the intermediate layer, and wherein the layer B is formed as the surface layer and the back layer.

In the above described invention, more preferably, the connection parts include first connection parts connecting the surface layer to the intermediate layer regularly and second connection parts connecting the back layer to the intermediate layer regularly, wherein each first connection part is formed at a position corresponding to a middle position between the neighboring two second connection parts.

In the above described invention, further preferably, the connection parts include first connection parts connecting the surface layer to the intermediate layer regularly and second connection parts connecting the back layer to the intermediate layer regularly, wherein first connection parts are formed at positions corresponding to positons of the second connection parts.

The invention capable of solving the above problem is a multiply gauze woven fabric including a layer A formed by strongly stretching warps fed from a first beam, a layer B formed by loosely stretching warps than the layer A, the warps being fed from a second beam having a feeding speed higher than that of the first beam, and connection parts connecting the layer A to the layer B.

The invention capable of solving the above problem is clothes formed by using the multiply gauze woven fabric.

The invention capable of solving the above problem is bedding formed by using the multiply gauze woven fabric.

Advantageous Effect of Invention

The multiply gauze woven fabric of the present invention is excellent in transparency preventing property, heat-retaining property, water absorbency, breathability, and comfort for skin (softness) in comparison with the conventional multiply gauze woven fabric.

The multiply gauze woven fabric of the present invention retains lightweight of the conventional multiply gauze woven fabric.

In view of the above, the multiply gauze woven fabric of the present invention is suitable to be applied to cloth for clothes or bedding.

DESCRIPTION OF EMBODIMENTS

First Embodiment

—Gauze Structure and Weaving Method—

Figure 1:
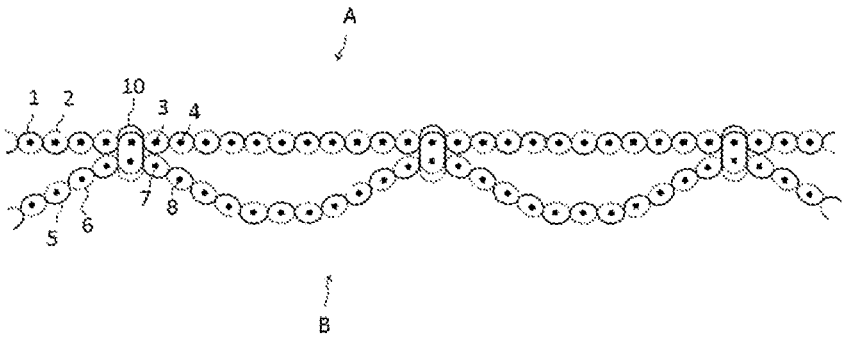
FIG. 1 is a cross sectional view of a two-ply gauze woven fabric according to a first embodiment of the present invention.

FIG. 1 is a cross sectional view of a multiply gauze woven fabric according to a first embodiment of the present invention. The present invention is directed to a N (N is an integer 2 or greater)-ply gauze woven fabric. Here, in order to facilitate understanding of the invention, a two-ply gauze woven fabric will be exemplified.

A two-ply gauze woven fabric is equipped with a surface-layer gauze and a back-layer gauze.

The surface-layer gauze is formed of warps (lengthwise yarns) 1, 2 and wefts (crosswise yarns) 3, 4.

Warps 1, 2 for surface-layer is fed from a first beam. A warp feeding speed of the first beam is almost equivalent to a feeding speed employed in a typical gauze weaving.

At the time, a tensile strength of warps 1, 2 is also adjusted according to the warp feeding speed.

Wefts 3, 4 are drawn across the warps during the feeding of warps. Accordingly, a tight layer A (a typical gauze) is formed.

A back layer gauze is formed of warps (lengthwise yarns) 5, 6 and wefts (crosswise yarns) 7, 8.

Warps 5, 6 for the back layer are fed from a second beam. A feeding speed of the second beam is 0.5 to 5.0%, preferably 1.5 to 3.0%, higher than the feeding speed of the first beam.

At the time, a tensile strength of warps 5, 6 is adjusted to less than 0.8-times, preferably less than 0.6-times, of the tensile strength of warps 1, 2.

Wefts 7, 8 are drawn across the warps during the feeding of warps. Accordingly, a loosened layer B in comparison with the tensile strength of the warps of the layer A is formed.

The same number of wefts 3, 4 and wefts 7, 8 are drawn across the warps equally spaced.

Because the feeding speed of the second beam is higher than the feeding speed of the first beam, a length of warps 5, 6 becomes longer than a length of warps 1, 2. On the other hand, the layer A and the layer B have the same length in a warp direction. As a result, the layer B is loosened than the layer A.

Concurrently with the forming of the layer A and the layer B, the layer A and the layer B are connected with each other in an appropriate way. The connection parts may be formed by warps or by wefts. According to an example in the drawing, warp 2 and weft 8 are entwined with each other and, concurrently, warp 5 and weft 4 are entwined with each other, thereby forming a connection part 10.

—Effect—

Figure 2:
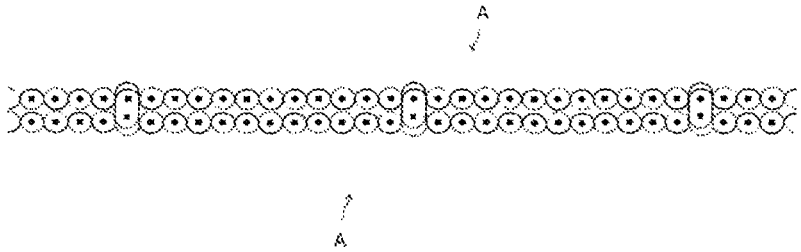
FIG. 2 is a cross sectional view of a two-ply gauze woven fabric produced by the conventional technology.

FIG. 2 illustrates a two-ply gauze woven fabric (conventional technology) composed of two sheets of typical gauze combined together. An effect of the present embodiment will be described below by comparing to the conventional technology.

Improvement of Transparency Preventing Property, Heat-Retaining Property, Water Absorbency, and Breathability In the conventional technology, warps for a surface-layer and warps for a back layer are fed from the same beam. Therefore, the warps for both of the surface-layer and the back layer are fed at same feeding speed. As a result thereof, a flat two-ply gauze is formed. There is no space formed between two sheets of gauze. Transparency preventing property, heat-retaining property, and water absorbency improve because the two sheets of gauze are combined. The improvement, however, is not remarkable. Breathability degrades because of the two-ply structure.

To the contrary, in the first embodiment, the loosened layer B creates a space between two sheets of gauze. With two sheets of thin gauze, the resulting two-ply gauze can have a thickness. Owing to the space and the thickness, transparency preventing property, heat-retaining property, water absorbency, and breathability can be improved in comparison with the gauze fabric produced by the conventional technology.

In view of the above, the gauze fabric according to the first embodiment is suitable for cloth to be applied to clothes (gowns, pajamas, shirts, pants, articles for infants, etc.) and bedding (sheets, blankets, pillow covers, etc.).

For example, breathability works during hot summer and heat retaining property works during cold winter. Users can feel coolness in summer and warmness in winter.

Further, when the gauze fabric according to the first embodiment is used for pajamas or sheets, the space absorbs night sweats as well as breathability works to dissipate excessive body temperature while sleeping. When the air temperature is going down at dawn, the heat-retaining property works. That is, the gauze fabric according to the first embodiment can keep comfortability throughout while sleeping.

Improvement of Comfort for Skin

In the conventional technology, produced is a flat two-ply gauze and thus, when the gauze is applied to clothes or bedding, the cloth clings to a person's skin when he sweats. Further, such gauze has no bounce and is stiffness feeling.

To the contrary, in the first embodiment, a combination of the loosened layer B and the connection parts 10 generates concave/convex. When the convex portions contact skin, suitable bounce works. Therefore, a user can feel softness. More specifically, because only convex portions touch the skin (because convex portions reduce the contact area), stickiness can be reduced when sweating. As described above, feeling of comfort for skin can be improved more than that of the conventional technology.

Incidentally, upon shrinkage, wefts are bound at connection parts 10. This makes the shrinkage in a weft direction be changed. More specifically, wefts shrink less in areas before and after the connection parts 10, whereas, shrink more in the middle area of two neighboring connection parts 10. This generates concave/convex also in a weft direction and thus the feeling of comfort for skin improves more.

Retaining of Lightweight

The first embodiment and the conventional technology are different from each other only in the point of warps 5, 6 for back layer but are common to each other in surface-layer and wefts. A ratio of warps 5, 6 of the two-ply gauze is 25% (=¼).

If the feeding speed of the second beam is 5.0% higher (i.e., longer yarn=heavier yarn) than the feeding speed of the first beam, the gauze fabric according to the first embodiment comes to be 1.25% (=25%×5%) heavier than the gauze fabric produced by the conventional technology.

Only with such increase in weight, users would not notice about the difference of weight when two-ply gauze woven fabric is applied to clothes or bedding. In other words, lightweight of gauze woven fabric can be kept.

Second Embodiment

—Gauze Structure and Weaving Method—

Figure 3:
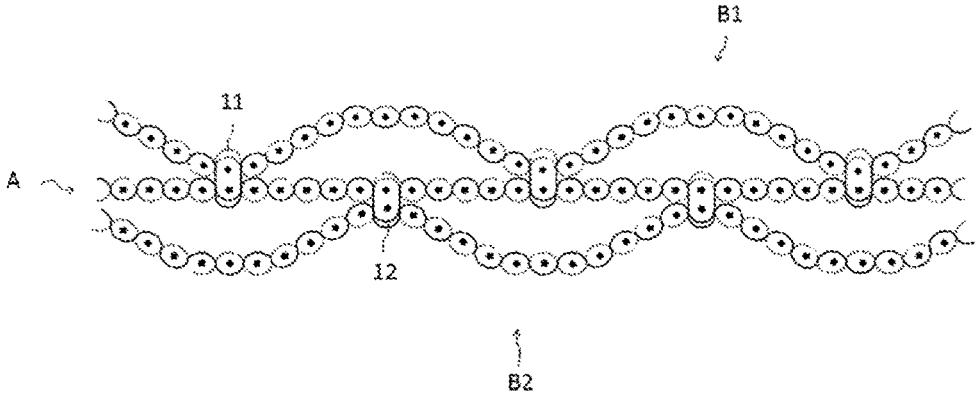
FIG. 3 is a cross sectional view of a three-ply gauze woven fabric according to a second embodiment of the present invention.

FIG. 3 is a cross sectional view of a three-ply gauze woven fabric according to a second embodiment of the present invention.

A three-ply gauze woven fabric is equipped with a surface-layer gauze, an intermediate layer gauze, and a back-layer gauze.

Warps are fed from a first beam and wefts are drawn across the warps, thereby forming a tight layer A as the intermediate layer gauze.

Warps are fed from a second beam and wefts are drawn across the warps, thereby forming a loosened layer B1 as the surface-layer gauze and concurrently forming a loosened layer B2 as the back-layer gauze.

At the time, a feeding speed of the second beam is higher than a feeding speed of the first beam.

Concurrently with forming of the layer A and forming of the layer B1 and the layer B2, connection parts 11 connecting the layer A to the layer B1 regularly and connection parts 12 connecting the layer A to the layer B2 regularly are formed. The connection parts 11 and the connection parts 12 are formed at same intervals.

Each connection part 11 is formed at a position corresponding to a position in the middle of the neighboring two connection parts 12. Further, each connection part 12 is formed at a position corresponding to a position in the middle of the neighboring two connection parts 11. As a result, the surface-layer gauze and the back-layer gauze are placed in parallel with each other.

—Effect—

The second embodiment is a modification of the first embodiment. More specifically, the layer B is provided on both sides of the layer A. Therefore, the second embodiment produces an effect equivalent to the effect produced by the first embodiment. Specially, transparency preventing property, heat-retaining property, and water absorbency improve more.

A thickness formed between the surface-layer gauze and the back-layer gauze of the three-ply gauze woven fabric is even in a warp direction, and thus transparency preventing property, heat-retaining property, water absorbency, and breathability work evenly in the warp direction. As a result, users will not have unnatural feeling.

Further, the three-ply gauze woven fabric has a gentle wavy appearance.

Third Embodiment

—Gauze Structure and Weaving Method—

Figure 4:
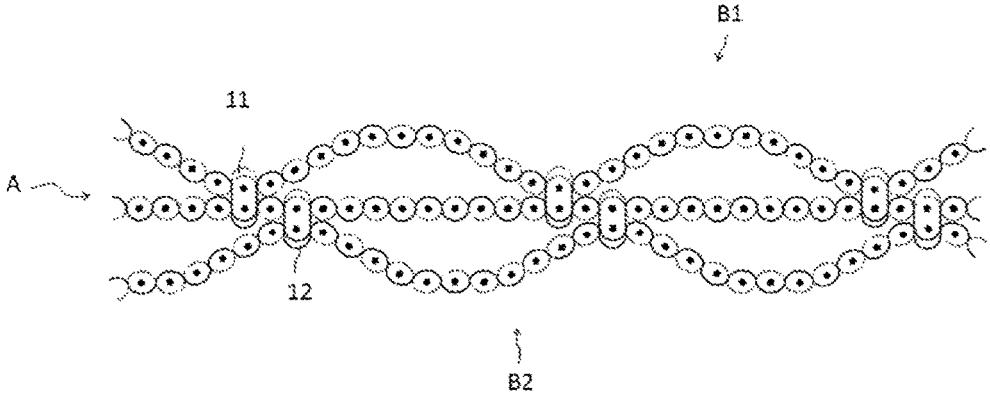
FIG. 4 is a cross sectional view of a three-ply gauze woven fabric according to a third embodiment of the present invention.

FIG. 4 is a cross sectional view of the three-ply gauze woven fabric according to a third embodiment of the present invention.

The three-ply gauze woven fabric of the third embodiment is common with that of the second embodiment in that the fabric is equipped with a surface-layer gauze, an intermediate layer gauze, and a back-layer gauze, in that a layer B (a layer B1 and a layer B2) is provided on both sides of a layer A, and in that connection parts 11 and connection parts 12 are formed.

On the other hand, the connection parts 11 are formed at positions corresponding to positions of the connection parts 12 in the third embodiment. Further, the connection parts 12 are formed at positions corresponding to positions of the connection parts 11. As a result, the surface-layer gauze and the back-layer gauze are placed to be approximately linearly symmetrical with the intermediate layer gauze.

Incidentally, "positions corresponding to" has a broad concept. It means that positions up to positions of the neighboring three wefts counted from original positions of connection parts are included. In the drawing, the connection parts 11 are positioned two wefts away from the corresponding connection parts 12.

When the connection parts 11 and the connection parts 12 are formed correspondingly at same positions, it is seen as if there are holes at the positions in appearance. If it is not preferred, the connection parts 11 and the connection parts 12 are to be positioned away from one another by 1 to 3 wefts.

—Effect—

The third embodiment is also a modification of the first embodiment as it is the case of the second embodiment. Therefore, the third embodiment produces an effect equivalent to that produced by the first embodiment.

Specially, a thickness formed between the surface-layer gauze and the back-layer gauze of the three-ply gauze woven fabric becomes thicker than that of the second embodiment. This improves transparency preventing property, heat-retaining property, and water absorbency more.

Further, the three-ply gauze woven fabric is formed into an appearance having sharp concave/convex shape. As described above, a design of appearance can be selected as required.

<Others>

Hereinabove, more specific embodiment has been described. The present invention is not limited only to the above described embodiments. In so far as the characteristics of the present invention are not impaired largely, various changes and modifications to the present invention should be construed as being included in the scope of the present invention.

For example, in the second embodiment and the third embodiment, it is possible to form the intermediate layer by combining two layers A, thereby forming a four-ply gauze woven fabric.

In the first to third embodiments, the connection parts are formed regularly but may be formed irregularly.

<Supplementary Note>

One of points of the present invention is that a multiply gauze is formed bulkily. The inventor of the present invention also studied about such a modification that the conventional multiply gauze is subjected to drying shrinkage to make it bulky.

If the multiply gauze is subjected to drying shrinkage to make it bulky, a weight per unit area increases. As a result, lightweight and breathability which are characteristics of gauze woven fabric cannot sufficiently be utilized.

Further, uneven shrinkage caused by the drying shrinkage invites poor appearance and makes cutting or sewing difficult. More specifically, such gauze woven fabric is not suitable for cloth in the use of clothes or bedding.

Therefore, it was necessary to study other method for making the multiply gauze bulky.

Incidentally, in the conventional method for weaving multiply gauze, a plurality of warps is apportioned from the same beam. It is theoretically possible to perform weaving by using two or more beams, which, however, degrades productivity. In view of the above, from the practical view point, such a concept that a plurality of beams is used in weaving gauze fabric is not conceivable by a person skilled in the art.

The inventor of the present invention came to have an idea of using two or more beams in the process of a study of making the multiply gauze bulky while retaining light-weight/breathability. The invention of the present application was made as a result of repeating trial and error as described above.

REFERENCE CHARACTER LIST

1, 2 warps of layer A
3, 4 wefts of layer A
5, 6 warps of layer B
7, 8 wefts of layer B
10, 11, 12 connection parts
Layer A tight layer formed by strongly stretching warps
Layer B loosened layer formed by loosely stretching warps

The invention claimed is:

1. A method for weaving multiply gauze comprising:
feeding warps from a first beam to form a tight layer A, where the layer A is a plain woven gauze;
concurrently feeding warps from a second beam having a feeding speed higher than that of the first beam to form a loosened layer B in comparison with the tensile strength of the warps of the layer A; and
forming connection parts connecting the layer A to the layer B;
wherein the feeding speed of the second beam is 0.5 to 5.0% higher than the feeding speed of the first beam.

2. The method for weaving multiply gauze according to claim 1:
wherein the multiply gauze is composed of a plurality of layers comprising a surface layer, an intermediate layer, and a back layer;
wherein the layer A is formed as the intermediate layer; and
wherein the layer B is formed as the surface layer and the back layer.

3. The method for weaving multiply gauze according to claim 2:
wherein the connection parts comprise
first connection parts connecting the surface layer to the intermediate layer regularly, and
second connection parts connecting the back layer to the intermediate layer regularly; and
wherein each first connection part is formed at a position corresponding to a middle position between the neighboring two second connection parts.

4. The method for weaving multiply gauze according to claim 2:
wherein the connection parts comprise
first connection parts connecting the surface layer to the intermediate layer regularly, and
second connection parts connecting the back layer to the intermediate layer regularly; and
wherein the first connection parts are formed at positions corresponding to positions of the second connection parts.

5. A multiply gauze woven fabric woven by the method for weaving multiply gauze according to claim 1.

* * * * *